US009657418B2

(12) United States Patent
Luberto

(10) Patent No.: US 9,657,418 B2
(45) Date of Patent: May 23, 2017

(54) SEWING MACHINE

(71) Applicant: Windham Sewing Machines LLC, Moosup, CT (US)

(72) Inventor: Anthony Luberto, Moosup, CT (US)

(73) Assignee: WINDHAM SEWING MACHINES, LLC, Moosup, CT (US)

( * ) Notice: Subject to any disclaimer, the term of this patent is extended or adjusted under 35 U.S.C. 154(b) by 573 days.

(21) Appl. No.: 14/211,753

(22) Filed: Mar. 14, 2014

(65) Prior Publication Data

US 2014/0261125 A1 Sep. 18, 2014

Related U.S. Application Data

(60) Provisional application No. 61/783,990, filed on Mar. 14, 2013.

(51) Int. Cl.
*D05B 69/04* (2006.01)
*D05B 55/14* (2006.01)

(52) U.S. Cl.
CPC ..... *D05B 69/04* (2013.01); *D05B 55/14* (2013.01)

(58) Field of Classification Search
CPC ..... D05B 69/04; D05B 55/14
USPC ..... 112/475.08, 312, 313, 323, 284
See application file for complete search history.

(56) References Cited

U.S. PATENT DOCUMENTS 2,699,745 A * 1/1955 Ayres ..... D05B 55/14 112/221
3,026,831 A * 3/1962 Johnson ..... D05B 19/00 112/221
3,369,510 A * 2/1968 Taketomi ..... D05B 19/00 112/459
3,598,070 A * 8/1971 Rosenberg ..... D05B 35/102 112/309
3,641,957 A * 2/1972 Hanyu ..... D05B 19/00 112/459
3,782,311 A * 1/1974 Adams ..... D05B 81/00 112/450
4,542,707 A * 9/1985 Balzer ..... D05B 35/107 112/131
4,852,506 A * 8/1989 Salganik ..... D05B 3/02 112/155
5,099,776 A * 3/1992 Jimenez ..... D05B 3/02 112/221
5,267,521 A * 12/1993 Chen ..... D05B 3/02 112/459

(Continued)

*Primary Examiner* — Danny Worrell
(74) *Attorney, Agent, or Firm* — Cantor Colburn LLP

(57) ABSTRACT

A needle drive assembly for a sewing machine includes a drive shaft rotatable about a drive shaft axis and a needle drive cam operably connected to the drive shaft and rotatable therewith. A needle drive race is slidably connected to the needle drive cam via a cam pin secured to the needle drive cam and at least partially extending through the needle drive race. A needle is assembly affixed to the needle drive race and includes a needle bar and a needle secured to the needle bar. Rotary motion of the drive shaft and needle drive cam about the drive shaft axis is translated into a needle path via the needle drive race, the needle path including a substantially vertical downstroke from a stroke peak to a stroke depth, a horizontal carry portion from the stroke depth and a curvilinear or linear upstroke from the horizontal carry portion to peak.

35 Claims, 12 Drawing Sheets

(56) References Cited

U.S. PATENT DOCUMENTS

| | | | | | |
|---|---|---|---|---|---|
| 5,309,854 | A * | 5/1994 | Mulcahey | D05B 27/04 | 112/313 |
| 5,501,164 | A * | 3/1996 | Porter | D05B 11/005 | 112/176 |
| 5,526,761 | A * | 6/1996 | Mulcahey | D05B 27/04 | 112/314 |
| 5,653,185 | A * | 8/1997 | Badillo | D05B 29/12 | 112/168 |
| 5,678,502 | A * | 10/1997 | Mulcahey | D05B 11/005 | 112/2.1 |
| 6,145,457 | A * | 11/2000 | Imaeda | D05B 3/02 | 112/221 |
| 2014/0261125 | A1 * | 9/2014 | Luberto | D05B 55/14 | 112/475.08 |

* cited by examiner

SEWING MACHINE

BACKGROUND

The subject matter disclosed herein generally relates to machines for sewing woven or non-woven materials.

Some traditional heavy-duty sewing machines, such as those used primarily for sewing of assembly of relatively thin, lightweight materials such as nylon, cloth or canvas fabric, typically include a walking foot with pendulum motion needle drive systems. When used for sewing heavier or thicker materials such as leather, a top stitch formed by the machine changes with thickness of the material due to the pendulum motion, which is undesirable.

Other types of machines, hook and awl stitchers are often used for sewing of leather items, such as saddlery and heavy harnesses. These machines are limited to heavy leather stitching, however, as the hook will catch on thread of fabric materials, and will cause bunching of even lightweight leathers. Hook and awl stitchers are complex and difficult to use. Thus there remains a need for a sewing machine that can sew woven or non-woven materials that are less compliant than woven fabrics, especially one that is easily portable and usable by a hobbyist or a professional.

BRIEF DESCRIPTION

In one embodiment, a needle drive assembly for a sewing machine includes a drive shaft rotatable about a drive shaft axis and a needle feed cam operably connected to the drive shaft and rotatable therewith. A needle drive race is slidably connected to the needle feed cam via a cam pin secured to the needle feed cam which extends at least partially through the needle drive race. A needle assembly is affixed to the needle drive race and includes a needle bar and a needle secured to the needle bar. Rotary motion of the drive shaft and needle feed cam about the drive shaft axis is translated into a needle path via the needle drive race. The needle path includes a substantially vertical downstroke from a stroke peak to a stroke depth, a horizontal carry portion from the stroke depth, a substantially vertical upstroke from the needle plate, and a curvilinear or linear return portion to the stroke peak.

In another embodiment, a sewing machine includes a housing assembly and a needle drive assembly disposed at least partially in the housing, including a drive shaft rotatable about a drive shaft axis and a needle feed cam operably connected to the drive shaft and rotatable therewith. A needle drive race is slidably connected to the needle feed cam via a cam pin secured to the needle feed cam which extends at least partially through the needle drive race. A needle assembly is affixed to the needle drive race and includes a needle bar and a needle secured to the needle bar. Rotary motion of the drive shaft and needle feed cam about the drive shaft axis is translated into a needle path via the needle drive race. The needle path includes a substantially vertical downstroke from a stroke peak to a stroke depth, a horizontal carry portion from the stroke depth, a substantially vertical upstroke from the needle plate, and a curvilinear or linear return portion to the stroke peak.

In yet another embodiment, a sewing machine includes a drive system to urge movement of a needle assembly. A path of the needle assembly includes a substantially vertical downstroke from a stroke peak to a stroke depth, a horizontal carry portion from the stroke depth, a substantially vertical upstroke from the horizontal carry portion, and a curvilinear or linear return portion upstroke from the vertical upstroke to the stroke peak.

In still another embodiment, a method of sewing includes moving a needle through a needle path including a substantially vertical downstroke from a stroke peak to a stroke depth, a horizontal carry portion from the stroke depth, a vertical upstroke, and a return portion to the stroke peak. The needle path is provided by a drive shaft rotatable about a drive shaft axis, needle feed cam operably connected to the drive shaft and rotatable therewith, a needle drive race slidably connected to the needle feed cam via a cam pin secured to the needle feed cam and at least partially extending through the needle drive race, and a needle assembly affixed to the needle drive race including. The needle assembly includes a needle bar and a needle secured to the needle bar.

These and other advantages and features will become more apparent from the following description taken in conjunction with the drawings.

BRIEF DESCRIPTION OF THE DRAWINGS

The above and other aspects, advantages and features of this disclosure will become more apparent by describing in further detail exemplary embodiments thereof with reference to the accompanying drawings, in which.

The detailed description explains the disclosed embodiments, together with advantages and features, by way of example with reference to the drawings.

DETAILED DESCRIPTION

Sewing materials having substantial thicknesses can be difficult if prior art pendulum-type needle motion is utilized because the needle tends to drag or hang up in the material when retracting from the material, after the presser foot holding the material has already released. This results in bunching or other unintentional movement of the material during the sewing operation. Disclosed is a sewing machine including a needle motion path ensuring release of the needle from the material regardless of the material thickness. The disclosed needle motion permits the sewing of materials having substantial thickness, e.g. leather and other materials that are substantially noncompliant, e.g. plastic films, without bunching or movement. In some instances, the material is ½" or ¾" in thickness or thicker. Threads used in such cases are range in thread gauge from 69 to about 346. The stitch type produced by the machine disclosed herein is a lockstitch, in particular a 301 lockstitch with one needle thread and one bobbin thread that interlock.

Figure 1:
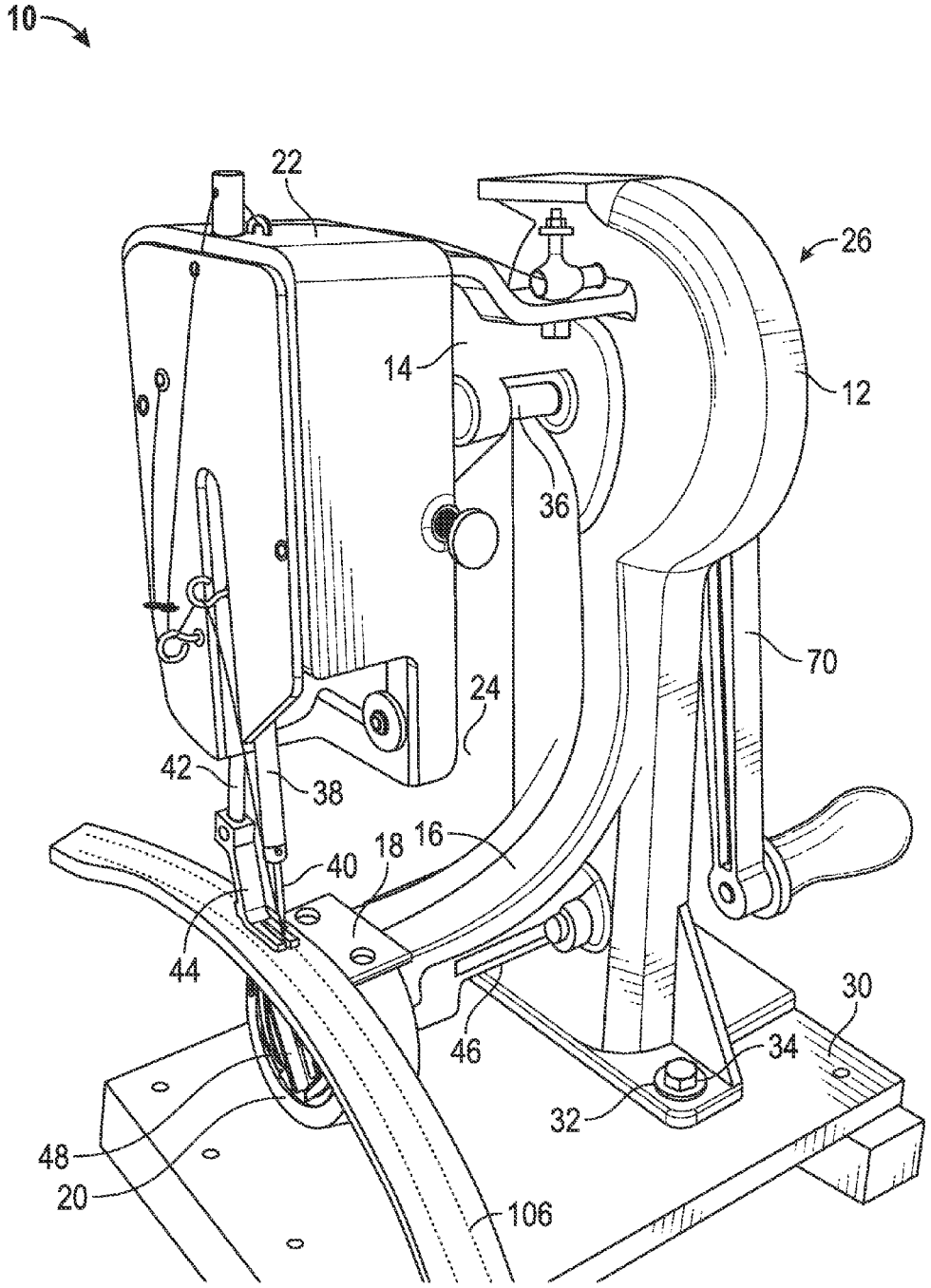
FIG. 1 is a perspective view of an embodiment of a sewing machine.

Shown in FIG. 1 is an embodiment of a sewing machine 10. The sewing machine 10 generally includes a drive housing 12 having an upper arm 14 and a lower arm 16 extending in one direction therefrom. A needle plate 18 and shuttle hook housing 20 are located at a terminal end of the lower arm 16, while a needle bar housing 22 is located at a terminal end of the upper arm 14. The needle bar housing 22 and the needle plate 18 define a throat 24 of the sewing machine 10 therebetween. In some embodiments, the drive housing 12, upper arm 14, lower arm 16, shuttle hook housing 20 and needle bar housing 22 are formed as a unitary housing assembly 26 by, for example, casting. It is to be appreciated, however, that other materials and processes may be utilized to form the housing assembly 26. In some embodiments, an arm length of the upper arm 14 and/or the lower arm 16 is about 9 inches (about 23 cm). It is to be appreciated, however, that sewing machines 10 having other arm lengths, for example, arm lengths of about 6 inches (about 15 cm) or 12 inches (about 30.5 cm) or 15 inches (about 38 cm) are contemplated by the present disclosure. Further, as shown in FIG. 1, the sewing machine 10 is securable to a table 30, bench or the like via mounting holes 32 extending through, for example the drive housing 12 to accept bolts 34 or other fasteners. An upper drive shaft 36 extends from the drive housing 12 through or along the upper arm 14 to the needle bar housing 22 and drives motion of a needle assembly 38 including a needle 40. The upper drive shaft 36 further drives motion of a presser foot assembly 42 including a presser foot 44. A lower drive shaft 46 extends from the drive housing 12 through or along the lower arm 16 to the shuttle hook housing 20 to drive motion of a shuttle hook 48 located in the shuttle hook housing 20. Movement of the shuttle hook 48, presser foot assembly 42 and needle bar assembly 38 will be described in more detail in the paragraphs that follow below.

Figure 2:
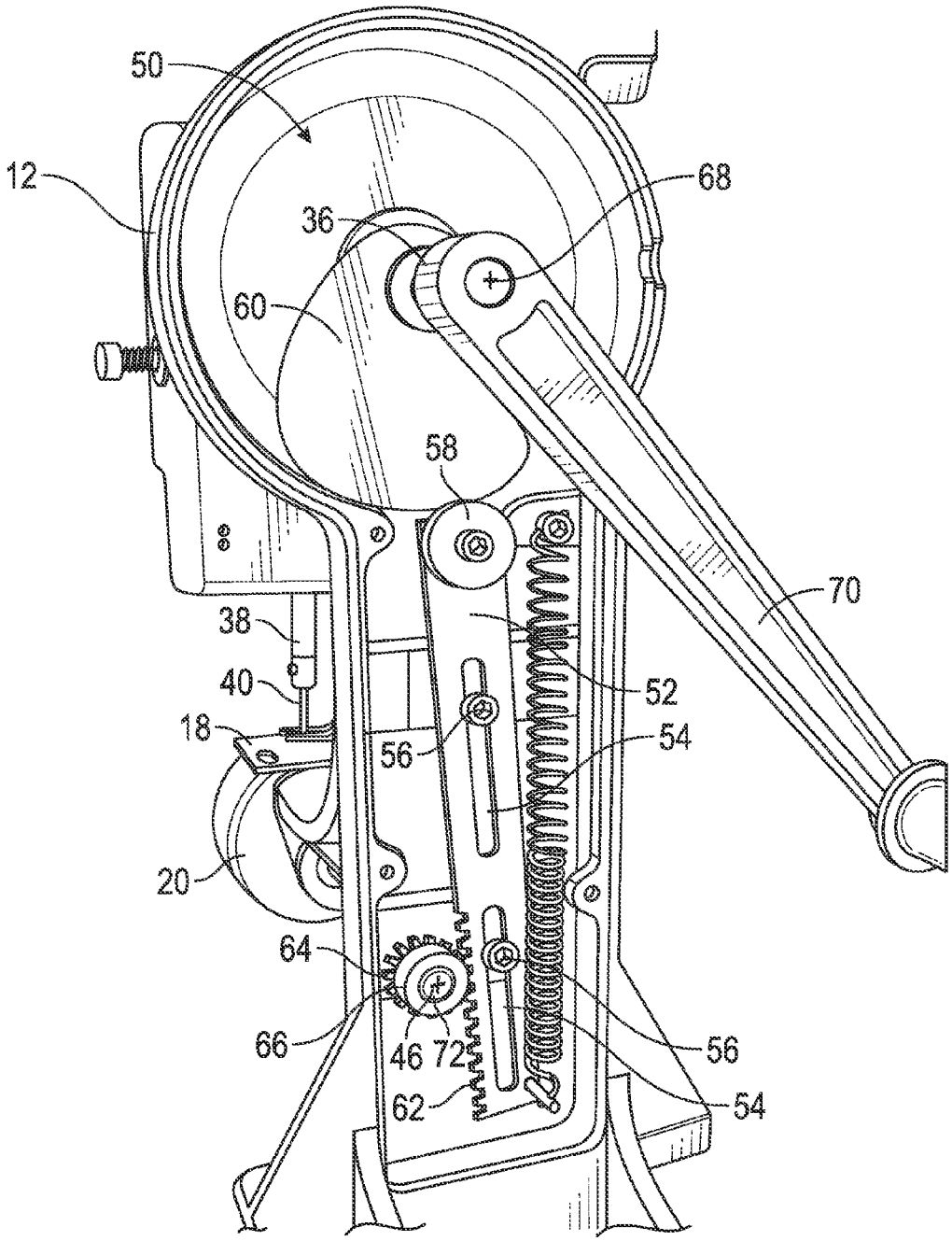
FIG. 2 is an end view of a drive side of a sewing machine showing an embodiment of a drive assembly.
Figure 3:
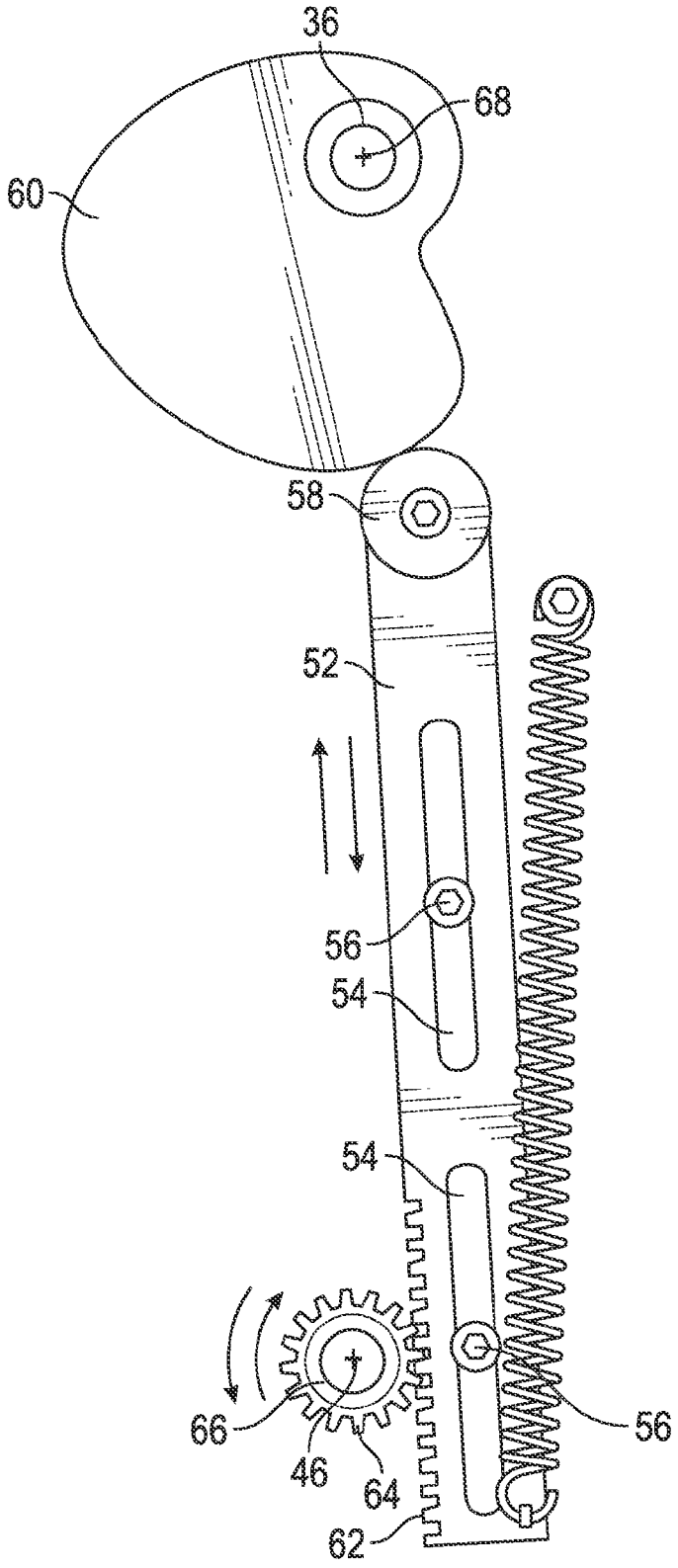
FIG. 3 is another end view of a drive side of a sewing machine showing an embodiment of a drive assembly.

Referring now to FIGS. 2 and 3, motion of the upper drive shaft 36 and lower drive shaft 46 are coordinated by a drive assembly 50 located at the drive housing 12. The drive assembly 50 includes a drive rack 52 slidingly located at the drive housing 12. In the embodiment of FIG. 2, the drive rack 52 includes two rack slots 54 through which rack pins 56 extend to secure the drive rack 52 to the drive housing 12. The drive rack 52 further includes a drive roller 58 that is interactive with a drive cam 60 affixed to the upper drive shaft 36, and a plurality of rack teeth 62 interactive with gear teeth 64 of a pinion gear 66 affixed to the lower drive shaft 46. In general, motion of the drive assembly 50 is driven by rotation of the upper drive shaft 36 about an upper drive shaft axis 68. This rotation may be achieved manually via, for example, a handle 70 secured to the upper drive shaft 36. Alternatively, the rotation may be driven by a motor (not shown) operably connected to the upper drive shaft 36, or by a wheel (not shown) or other such device. The drive cam 60 has an asymmetric shape so that as the upper drive shaft 36 and the drive cam 60 are rotated about the upper drive shaft axis 68, the drive roller 58, following a perimeter of the drive cam 60, moves upward and downward relative to the upper drive shaft 36 and the lower drive shaft 46 with the drive rack 52. The upward and downward movement of the drive rack 52 urges cyclical rotary movement of the pinion gear 66 and the lower drive shaft 46 about a lower drive shaft axis 72. Specific features of the cyclical motion are determined by the shape of the drive cam 60.

Figure 4:
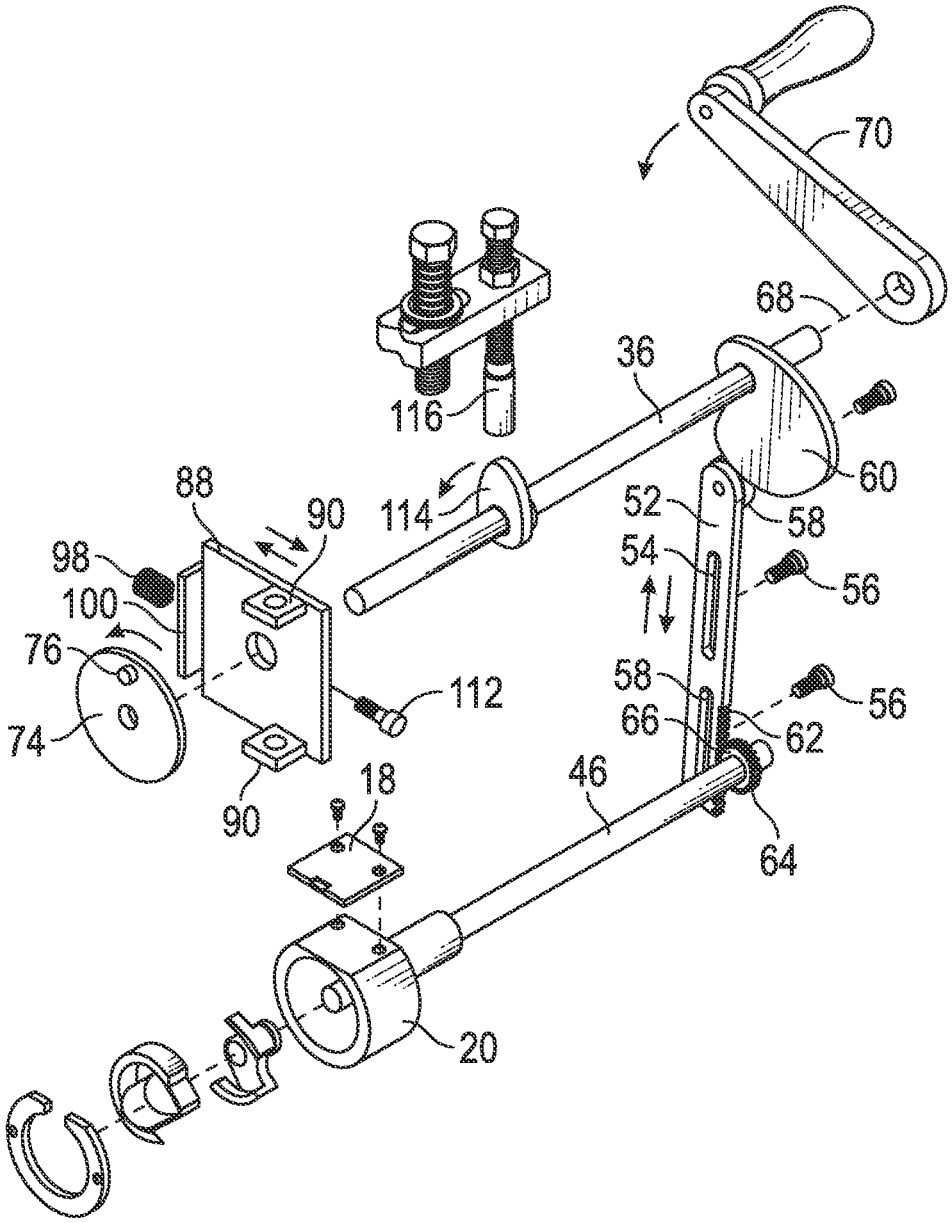
FIG. 4 is a partially exploded view of an embodiment of a drive system for a sewing machine.
Figure 5:
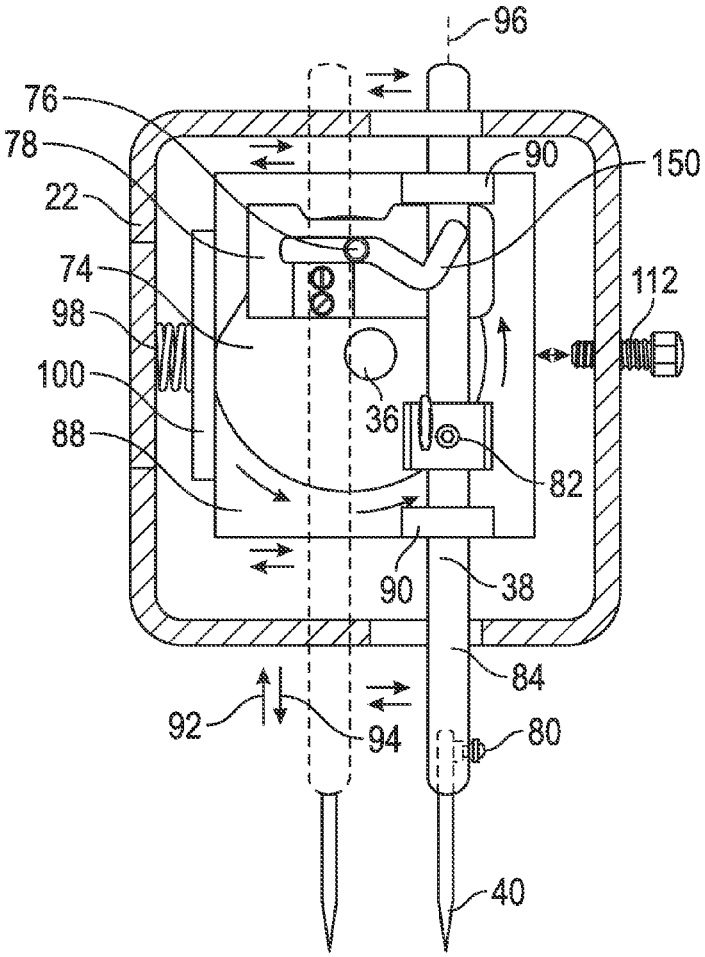
FIG. 5 is an end view of an embodiment of a needle bar assembly of a sewing machine.

Referring to the exploded view of FIG. 4, the upper drive shaft 36 extends from the drive housing 12 (shown in FIG. 1) to the needle bar housing 22 (shown in FIG. 1) and is connected to a needle feed cam 74. Referring now to FIG. 5, the needle feed cam 74 rotates about the upper drive shaft axis 68 with the upper drive shaft 36, and includes a cam pin 76 that extends at least partially through a needle drive race 78. While in the embodiment of FIG. 5, the cam pin 76 extends into the needle drive race 78, in other embodiments, it may be replaced by a ball or other similar feature. The needle feed cam 74 and the needle drive race 78 are configured to drive a selected motion of a needle assembly 38. The needle assembly 38 is affixed to the needle drive race 78 at a needle drive pivot 82 and includes a needle bar 84 with a needle 40 secured thereto. In some embodiments, as shown in FIG. 5, the needle 40 is secured in the needle bar 84 via a set screw 80. In other embodiments, other means may be utilized to secure the needle 40.

Figure 6:
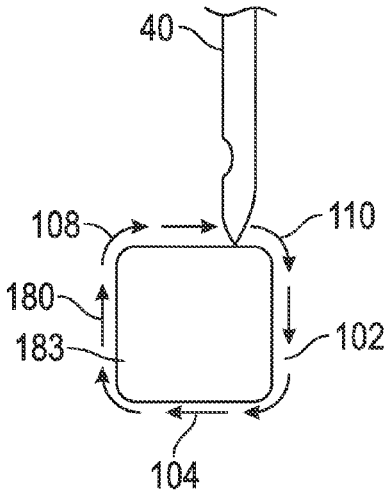
FIG. 6 is a schematic illustration of motion of an embodiment of a needle of a sewing machine.
Figure 7A:
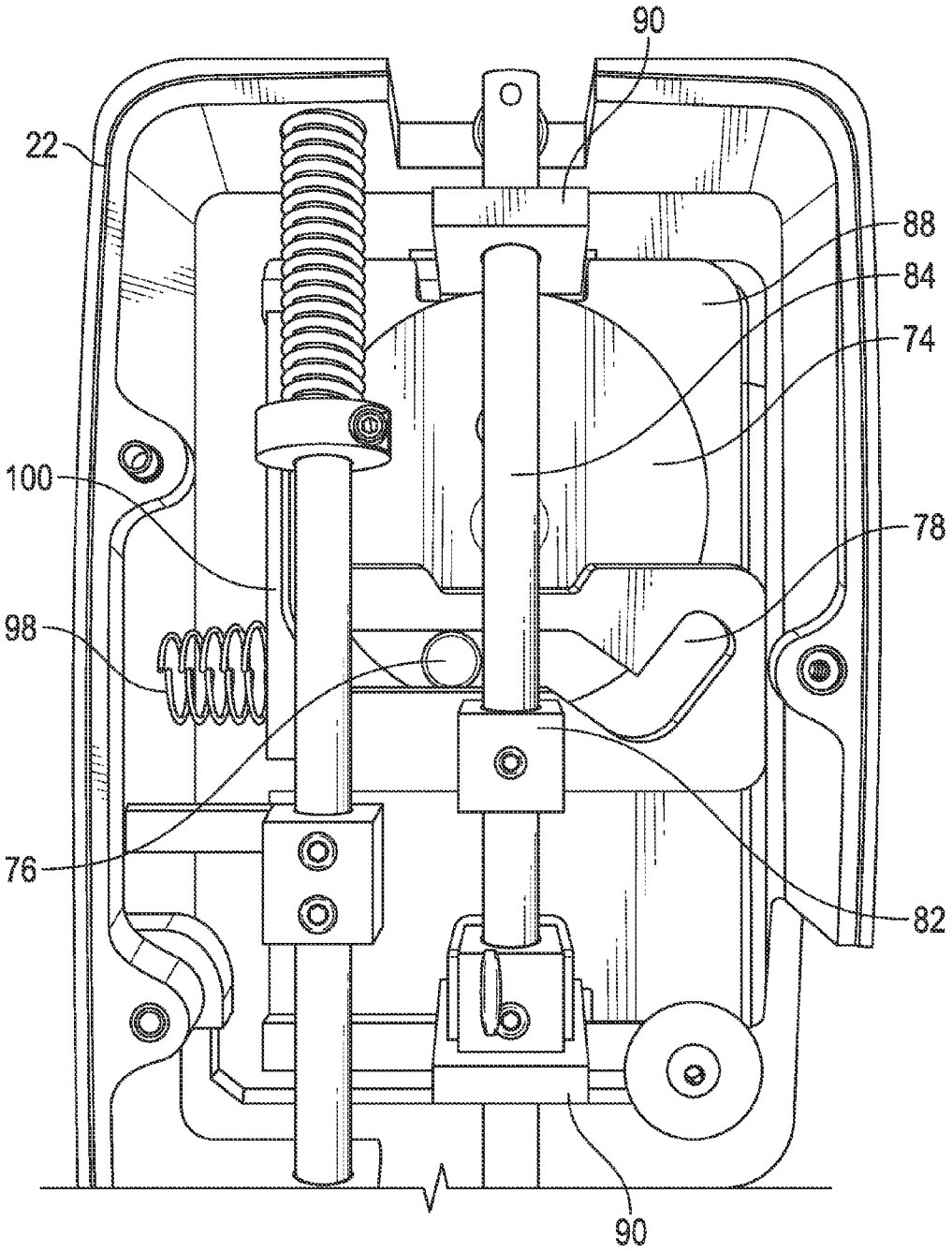
FIG. 7*a* is an end view of a needle side of a sewing machine showing an embodiment of a needle bar assembly.
Figure 7B:
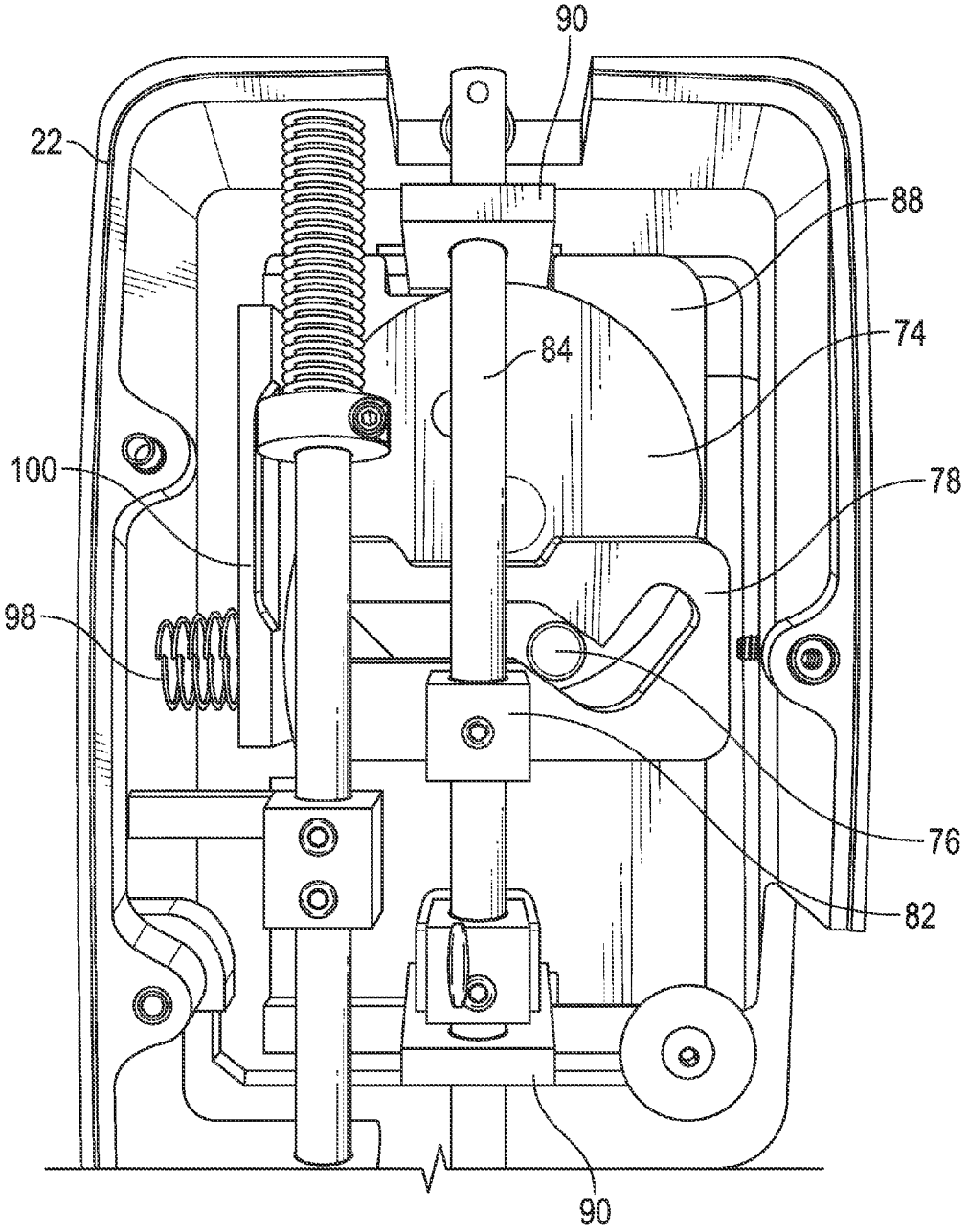
FIG. 7*b* is another end view of a needle side of a sewing machine showing an embodiment of a needle bar assembly.
Figure 7C:
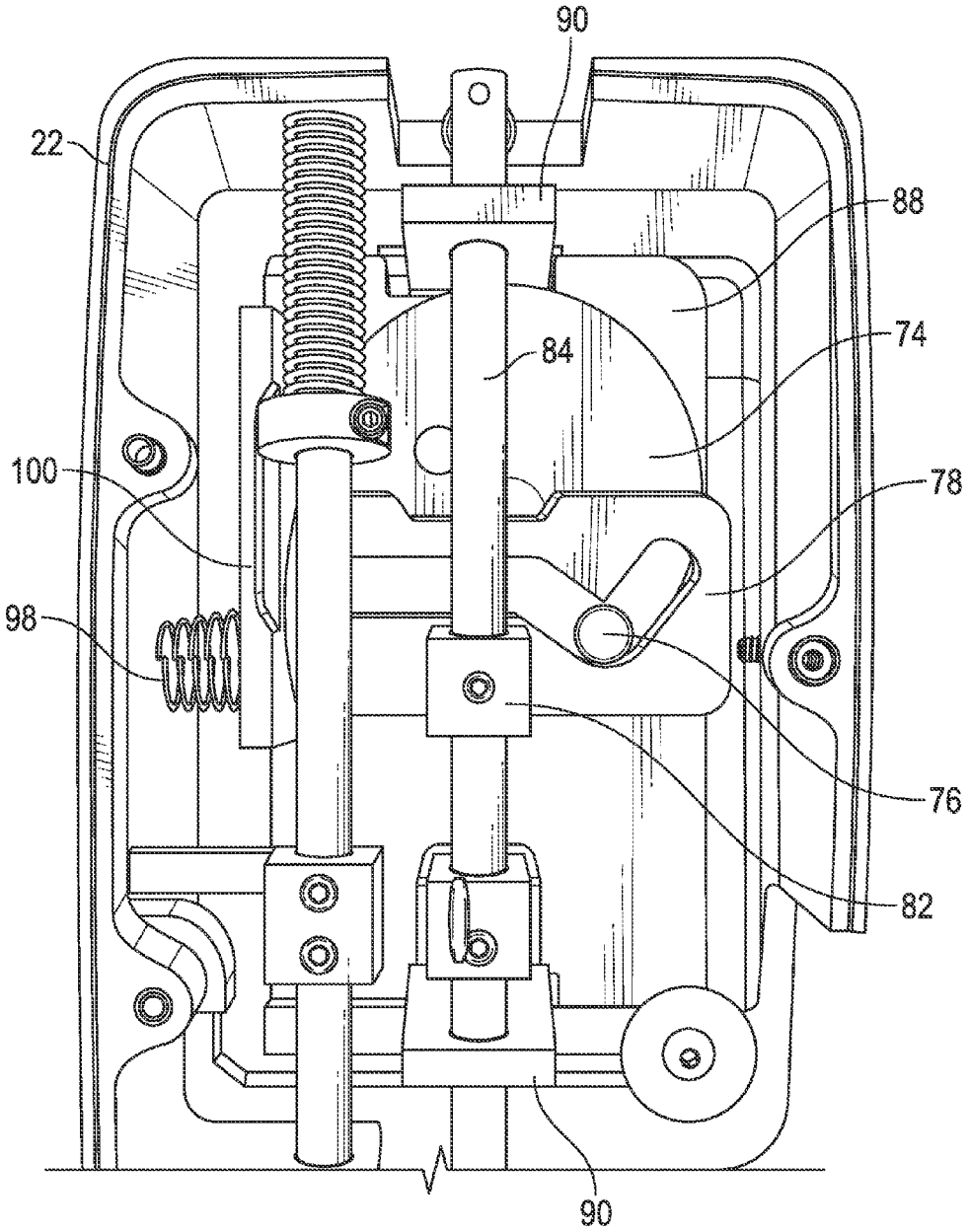
FIG. 7*c* is yet another end view of a needle side of a sewing machine showing an embodiment of a needle bar assembly.
Figure 7D:
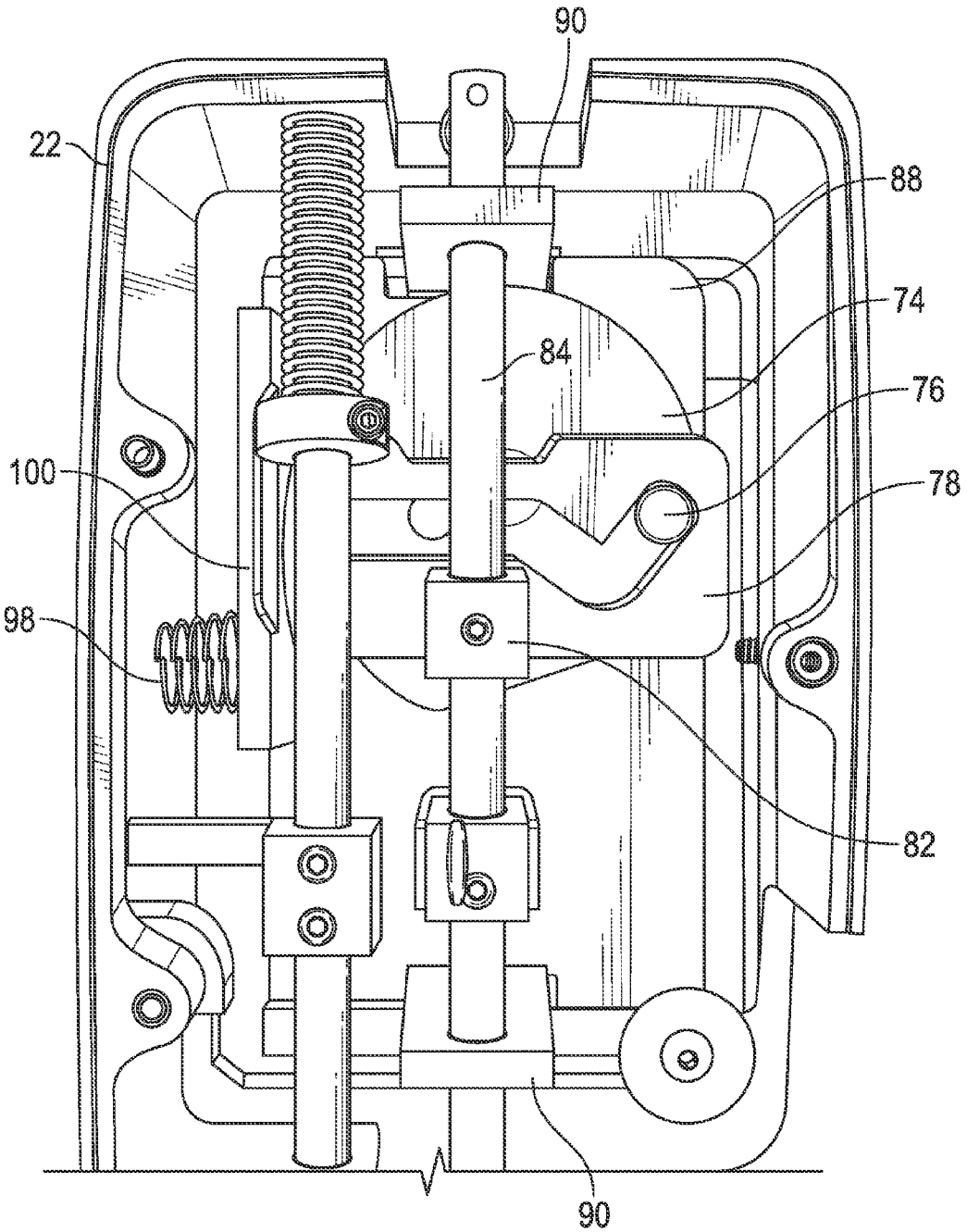
FIG. 7*d* is still another end view of a needle side of a sewing machine showing an embodiment of a needle bar assembly.

The needle assembly 38 and the needle feed cam 74 are secured to a mounting frame 88. The needle feed cam 74 is rotatably mounted to the mounting frame 88, while the needle assembly 38 is slidably secured to the mounting frame 88 through needle assembly eyelets 90 to allow the needle assembly 38 to slide in an upward direction 92 and a downward direction 94. A position of the mounting frame 88 in the needle bar housing 22 is biased toward a rearward position 96 by a biasing member, for example, a spring 98 and spring plate 100 affixed to the mounting frame 88 and abutting the needle feed cam 74. A cyclic motion path of the needle 40 is depicted in FIG. 6, and is further illustrated in FIGS. 7*a*-7*d*. Referring to FIG. 6, the motion path of the needle 40 is substantially rectangular or square in shape, with a vertical downstroke 102 in which the needle is pushed into an article 106 to be sewn (shown in FIG. 1), a horizontal carry portion 104 executed while the needle 40 is embedded in the article 106 to establish a stitch length, a substantially vertical upstroke 180 to release the needle 40 from the article 106, and a linear or curvilinear return portion 108 to return the needle 40 to a stroke peak 110, where the downstroke 102 is started again. In some embodiments, a length the vertical upstroke 180 is between about 50% and 80% as long as a length of the vertical downstroke 102. Further, in some embodiments, the needle 40 briefly pauses during the vertical upstroke 180, as will be described in more detail below. Referring again to FIG. 5, the stroke peak 110 corresponds with the cam pin 76 being located substantially at a 12 o'clock position. The stitch length, or length of the carry portion 104, is adjustable and controlled via stitch length screw 112 through the needle bar housing 22. The stitch length screw 112 limits travel of the mounting frame 88 toward the rearward position 96, thus limiting a length of the horizontal carry portion 104 and stitch length.

Figure 8:
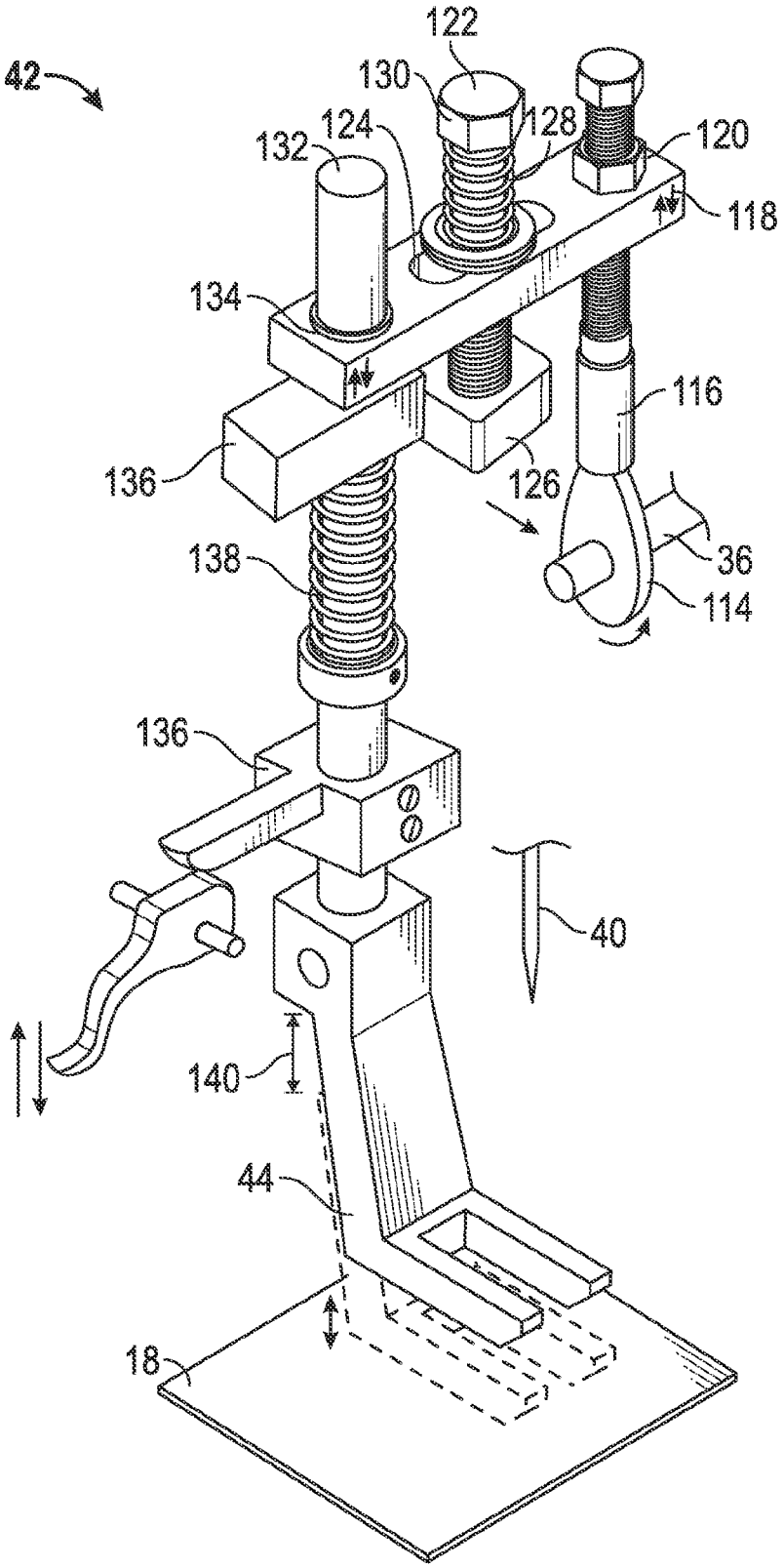
FIG. 8 is a perspective view of an embodiment of a presser foot assembly of a sewing machine.

Referring again to FIG. 4, the upper drive shaft 36 includes a presser foot cam 114, which is interactive with a presser foot follower pin 116 of the presser foot assembly 42. Referring now to FIG. 8, the follower pin 116 is slidably located in the needle bar housing 22, such that the follower pin 116 may freely traverse an upward and downward path. The travel of the follower pin in a downward direction is limited by the presser foot cam 114, and the upward direction by a position of adjustment bolt 120, set by the associated nut. The lift lock lever 118 is positioned by a center bolt 122 extending through an oversized lever slot 124 into a lever boss 126 in the needle bar housing 22. The lift lock lever 118 is biased toward the lever boss 126 by, for example, a lever spring 128 located between the lift lock lever 118 and a head 130 of the center bolt 122. A presser bar 132, with the presser foot 44 located at one end of the presser bar 132, extends through a presser hole 134 in the lift lock lever 118. The presser hole 134 is slightly oversized to the presser bar 132 and is located at an opposite end of the lift lock lever 118 from the follower pin 116, such that the center bolt 122 is between the presser hole 134 and the follower pin 116 along the lift lock lever 118. The presser bar 132 further extends through one or more presser bosses 136 with a biasing member, for example a presser spring 138, biasing the presser bar 132, and thus the presser foot 44 in a downward direction (axially along a presser bar axis 140), toward the needle plate 18.

When the upper drive shaft 36 is rotated causing rotation of the presser foot cam 114, the presser foot cam 114 urges the follower pin 116 upward, which in turn urges the lift lock lever 118 upward a distance defined by the position of the adjustment bolt 120. The bias of the lever spring 128 is overcome and the oversized nature of the lever slot 124 and the presser hole 134 allows the lift lock lever 118 to pivot. The pivot motion causes the wall of the oversized presser hole 134 to pinch and frictionally engage the presser bar 132 at the presser hole 134 and lift the presser foot 44 and move the presser foot 44 away from the needle plate 18. Further the oversized nature of the presser hole 134 allows for some free travel upward and downward of the presser bar 132 and the presser foot 44 when at rest or in a neutral position, to compensate for changing material thickness being fed between the needle plate 18 and the presser foot 44, without having to explicitly adjust the presser foot 44 position. Motion of the presser foot 44 is coordinated with motion of the needle 40 such that the presser foot 44 moves upwardly away from the needle plate 18 as the needle 40 enters the article 106 on the downstroke 102 and the presser foot 44 is lowered to the needle plate 18 and holds the article 106 when the vertical upstroke 180 of the needle 40 begins.

Figure 9:
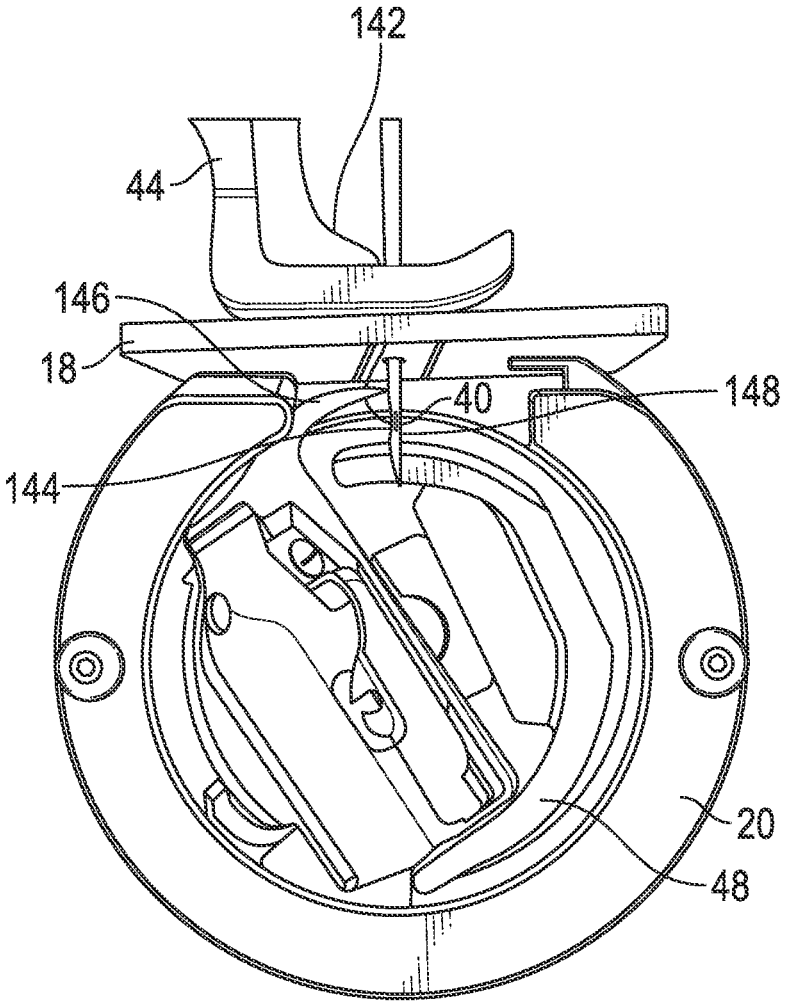
FIG. 9 is a perspective view of an embodiment of a shuttle hook assembly for a sewing machine.

Referring to FIG. 4, the lower drive shaft 46 extends through the lower arm 16 from the drive housing 12 to the shuttle hook housing 20. At the drive housing 20, rotation of the lower drive shaft 46 is coordinated with rotation of the upper drive shaft 36 by the drive cam 60 affixed to the upper drive shaft 36. The drive cam 60 interacts with the drive rack 52, which in turn interacts with the pinion gear 66 to drive cyclic rotary motion of the lower drive shaft 46. This motion is transferred to the shuttle hook 48 located in the shuttle hook housing 20. Referring now to FIG. 9, once the needle 40 begins the vertical upstroke 180, a portion of needle thread 142 forms a bulge 148 at a scarf side 144 of the needle 40. The needle 40 motion may pause briefly at a pause point 182 in the vertical upstroke 180. The shuttle hook 48 moves clockwise such that a shuttle hook finger 146 moves toward the needle 40 and passes at least partly through the bulge 148. The pause in needle 40 motion allows the shuttle hook finger 146 to pass into the bulge 148. At this point, the needle 40 jumps upwardly so that as the shuttle hook 48 continues its rotation, there is no collision with the needle 40. In some embodiments, the motion of the needle 40 changes speeds along the vertical upstroke 180. For example, the vertical upstroke 180 may include a first portion having a first rate of movement and second portion having a second rate of movement, wherein the first rate of movement is greater than the second rate of movement. The shuttle hook 48 carries the needle thread 142 as it rotates to the end of its stroke, at approximately the 6 o'clock position in some embodiments and the needle thread 142 is released. The rotation of the shuttle hook 48 is then reversed. Referring to FIG. 5, the above described jump in the needle 40 motion is a result of the shape of the needle drive race 78, in particular a transition into a downward sloping portion 150 of the needle drive race 78. Changing an angle of a length of this downward sloping portion 150 results in different characteristics of the jump in the needle 40 motion, for example, changing a height of the jump or a speed of the jump.

Figure 10:
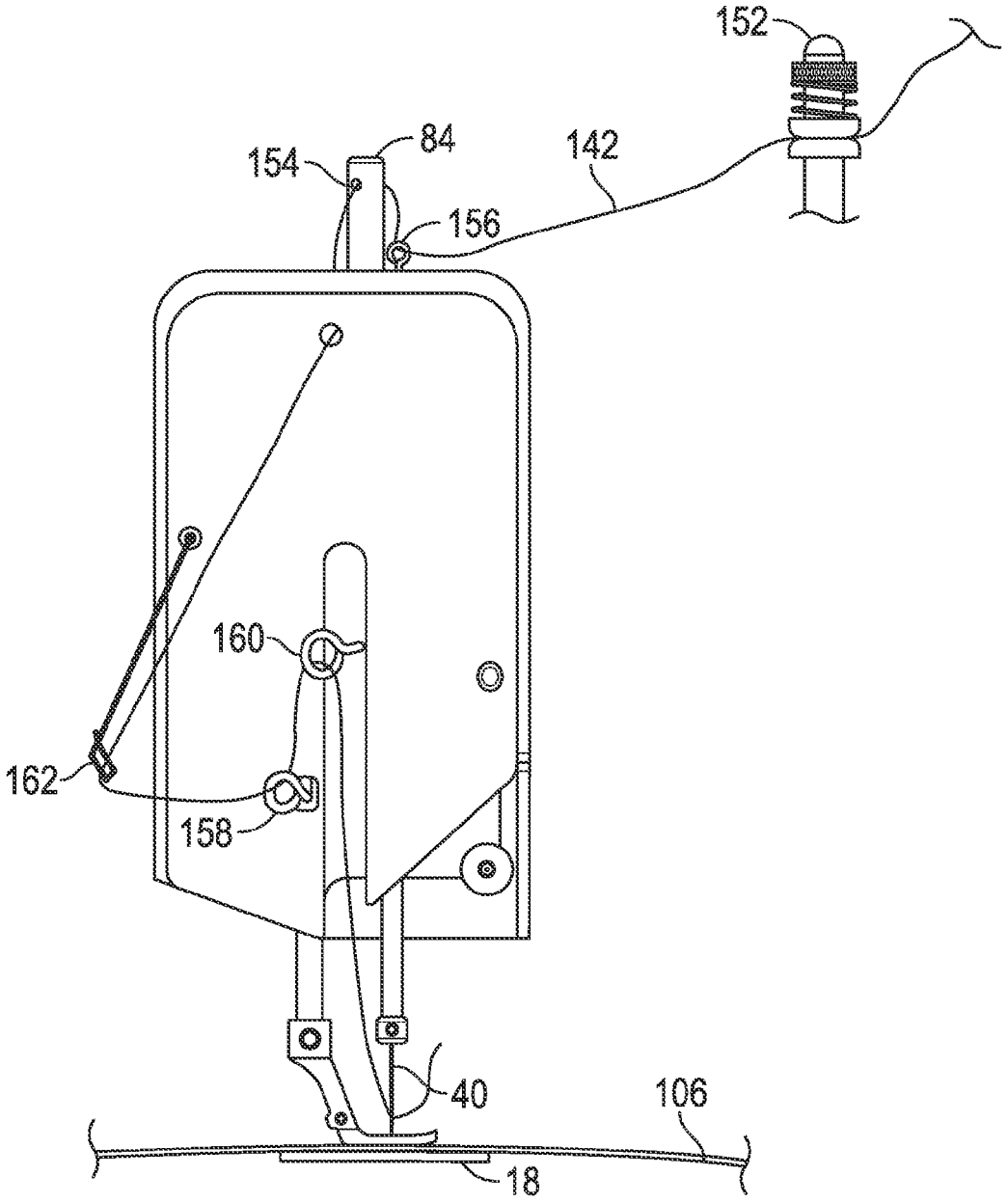
FIG. 10 is a perspective view of an embodiment of a thread takeup assembly for a sewing machine.

Referring to FIG. 10, the sewing machine 10 may include a double takeup of needle thread 142 to ensure a tight stitch in the article 106. The needle thread 142 is routed from a thread tensioning device 152 through eyelet 156 and a needle bar hole 154 in the needle bar 84. The thread 142 is then threaded through face plate opening 164, and in some embodiments, through a second tensioner, such as check spring 162. Check spring 162 reduces slack in the needle thread 142 when the needle 40 is in its downstroke. The needle thread 142 is then fed through a face plate eyelet 158, or other fixed location, and through a needle bar eyelet 160 and then through the needle 40. As the needle 40 begins its upward motion via upward motion of the needle bar 84, the needle thread 142 is pulled up into the article 106 after release of the needle thread 142 from the shuttle hook 48 via the tension on the needle thread 142 at the upward moving needle bar eyelet 160 and at the needle bar hole 154. This ensures adequate needle thread 142 is retrieved such that a stitch in the article 106 is sufficiently tight. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

Exemplary embodiments are described herein with reference to schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The invention claimed is:

1. A needle drive assembly for a sewing machine comprising:

a drive shaft rotatable about a drive shaft axis;

a needle feed cam operably connected to the drive shaft and rotatable therewith;

a needle drive race slidably connected to the needle feed cam via a cam pin secured to the needle feed cam and at least partially extending through the needle drive race; and a needle assembly affixed to the needle drive race including:

a needle bar; and a needle secured to the needle bar;

wherein rotary motion of the drive shaft and needle feed cam about the drive shaft axis is translated into a needle path via the needle drive race, the needle path including a substantially vertical downstroke from a stroke peak to a stroke depth, a horizontal carry portion from the stroke depth, a substantially vertical upstroke from the needle plate, and a curvilinear or linear return portion to the stroke peak.

2. The drive assembly of claim 1, further comprising a mounting frame onto which the needle feed cam and the needle assembly are located, a lateral position of the mounting frame biased by a biasing member, the bias overcome by rotation of the needle feed cam resulting in movement of the needle assembly along the horizontal carry portion.

3. The drive assembly of claim 2, further comprising a set screw to limit lateral travel of the mounting frame.

4. The drive assembly of claim 1, further wherein the needle drive race includes downwardly extending v-shaped portion defining an upward motion of the needle at an end of the horizontal carry portion.

5. The drive assembly of claim 1, further comprising a presser foot cam secured to the drive shaft and rotatable therewith to drive motion of a presser foot assembly.

6. The drive assembly of claim 5, wherein the presser foot assembly includes:

a lift lock lever;

a presser bar slidably located through the lift lock lever;

a presser foot disposed at an end of the presser bar, the presser bar and presser foot retained to allow only motion along a presser bar axis; and a follower pin secured to the lift lock lever and in operable communication with the presser foot cam;

wherein, when the lift lock lever is lifted on a side of the lift lock lever of the follower pin by the presser foot cam, the lift lock lever operably engages the presser bar to lift the presser bar and presser foot.

7. The drive assembly of claim 6, wherein a position of the presser bar is biased in a downward direction.

8. The drive assembly of claim 6, wherein the presser bar is slidable in the lift lock lever when the lift lock lever is not lifted by the presser foot cam.

9. The drive assembly of claim 1, further comprising a drive cam disposed at and rotatable with the drive shaft to link rotation of the drive shaft to rotation of a shuttle hook assembly via a lower drive shaft.

10. The drive assembly of claim 9, further comprising:

a drive rack in operable communication with the drive cam; and a pinion gear operably connected to the lower drive shaft and in operable communication with the drive rack to transfer rotary motion of the drive shaft into cyclic rotary motion of the lower drive shaft.

11. The drive assembly of claim 1, further comprising a handle to urge rotation of the drive shaft.

12. The drive assembly of claim 1, wherein the vertical upstroke has a length between about 50% and 80% of a vertical downstroke length.

13. The drive assembly of claim 1, wherein the path of the needle is substantially rectangular.

14. The drive assembly of claim 1, wherein the vertical upstroke comprises a jump.

15. The drive assembly of claim 1, wherein the motion of the needle includes a pause along the vertical upstroke.

16. The drive assembly of claim 1, wherein upstroke comprises a first portion having a first rate of movement and second portion having a second rate of movement, wherein the first rate of movement is greater than the second rate of movement.

17. A sewing machine comprising:

a housing assembly;

a needle drive assembly disposed at least partially in the housing including:

a drive shaft rotatable about a drive shaft axis;

a needle feed cam operably connected to the drive shaft and rotatable therewith;

a needle drive race slidably connected to the needle feed cam via a cam pin secured to the needle feed cam and at least partially extending through the needle drive race; and a needle assembly affixed to the needle drive race including:

a needle bar; and a needle secured to the needle bar;

wherein rotary motion of the drive shaft and needle feed cam about the drive shaft axis is translated into a needle path via the needle drive race, the needle path including a substantially vertical downstroke from a stroke peak toward a needle plate to a stroke depth, a horizontal carry portion along the needle plate, a substantially vertical upstroke from the needle plate, and a curvilinear or linear return portion to the stroke peak.

18. The sewing machine of claim 17, further comprising a mounting frame onto which the needle feed cam and the needle assembly are located, a lateral position of the mounting frame biased by a biasing member, the bias overcome by rotation of the needle feed cam resulting in movement of the needle assembly along the horizontal carry portion.

19. The sewing machine of claim 17, further comprising a set screw to limit lateral travel of the mounting frame.

20. The sewing machine of claim 17, further wherein the needle drive race includes a downwardly extending v-shaped portion defining an upward motion of the needle at an end of the horizontal carry portion.

21. The sewing machine of claim 17, further comprising a presser foot cam secured to the drive shaft and rotatable therewith to drive motion of a presser foot assembly.

22. The sewing machine of claim 21, wherein the presser foot assembly includes:

a lift lock lever;

a presser bar slidably located through the lift lock lever;

a presser foot disposed at an end of the presser bar, the presser bar and presser foot retained to allow only motion along a presser bar axis; and a follower pin secured to the lift lock lever and in operable communication with the presser foot cam;

wherein, when the lift lock lever is lifted on a side of the lift lock lever of the follower pin by the presser foot cam, the lift lock lever operably engages the presser bar to lift the presser bar and presser foot.

23. The sewing machine of claim 22, wherein a position of the presser bar is biased in a downward direction.

24. The sewing machine of claim 22, wherein the presser bar is slidable in the lift lock lever when the lift lock lever is not lifted by the presser foot cam.

25. The sewing machine of claim 17, further comprising a drive cam disposed at and rotatable with the drive shaft to link rotation of the drive shaft to rotation of a shuttle hook assembly via a lower drive shaft.

26. The sewing machine of claim 25, further comprising:

a drive rack in operable communication with the drive cam; and a pinion gear operably connected to the lower drive shaft and in operable communication with the drive rack to transfer rotary motion of the drive shaft into cyclic rotary motion of the lower drive shaft.

27. The sewing machine of claim 17, wherein the vertical upstroke has a length between about 50% and 80% of a vertical downstroke length.

28. The sewing machine of claim 17, wherein the path of the needle is substantially rectangular.

29. The sewing machine of claim 17, wherein the needle motion includes a pause along the vertical upstroke.

30. The sewing machine of claim 17, wherein the vertical upstroke comprises a jump.

31. The sewing machine of claim 17, wherein upstroke comprises a first portion having a first rate of movement and second portion having a second rate of movement, wherein the first rate of movement is greater than the second rate of movement.

32. A sewing machine comprising a drive system to urge movement of a needle assembly, the drive system including:

a needle feed cam rotatable about a drive axis; and a needle drive race slidably connected to the needle feed cam, the needle assembly affixed thereto;

wherein rotary motion of the needle feed cam about the drive axis is translated into a needle path of the needle assembly via the needle drive race; and wherein the needle path includes:

a substantially vertical downstroke from a stroke peak to a stroke depth;

a horizontal carry portion from the stroke depth;

a substantially vertical upstroke from the horizontal carry portion; and a curvilinear or linear return portion upstroke from the vertical upstroke to the stroke peak.

33. The sewing machine of claim 32, wherein the movement of the needle assembly is substantially rectangular.

34. The sewing machine of claim 32, wherein the vertical upstroke includes a pause.

35. A method of sewing comprising:

rotating a drive shaft about a drive shaft axis;

rotating a needle feed cam about the drive shaft axis via rotation of the drive shaft;

moving a needle feed race in a preselected race path, via an operable connection with the needle feed cam;

moving a needle assembly through a needle path via movement of the needle feed race driven by the rotation of the needle feed cam, the needle path including a substantially vertical downstroke from a stroke peak to a stroke depth, a horizontal carry portion from the stroke depth, a vertical upstroke, and a return portion to the stroke peak.

* * * * *